United States Patent [19]

Klinger

[11] 4,023,383

[45] May 17, 1977

[54] ELECTRICALLY CONTROLLED NEEDLE SELECTOR ARRANGEMENT FOR KNITTING MACHINES

[75] Inventor: Dieter Klinger, Aistaig, Germany

[73] Assignee: Mayer & Cie, Tailfingen, Germany

[22] Filed: Apr. 21, 1976

[21] Appl. No.: 679,134

[30] Foreign Application Priority Data

May 3, 1975 Germany ..... 2519896

[52] U.S. Cl. ..... 66/50 R

[51] Int. Cl.[2] ..... D04B 15/66; D04B 15/68; D04B 15/78

[58] Field of Search ..... 66/50 R, 50 A, 50 B, 66/25, 75 A

[56] References Cited

UNITED STATES PATENTS

| | | | |
|---|---|---|---|
| 2,025,463 | 12/1935 | Lombardi | 66/50 A |
| 3,535,892 | 10/1970 | Schmidt et al. | 66/50 R |
| 3,710,594 | 1/1973 | Bourgeois | 66/50 R |
| 3,742,733 | 7/1973 | Paepke | 66/50 R |
| 3,890,805 | 6/1975 | Bourgeois | 66/50 R |
| 3,930,383 | 1/1976 | Nuber | 66/25 |
| 3,972,206 | 8/1976 | Mureso | 66/50 R |

FOREIGN PATENTS OR APPLICATIONS

| | | | |
|---|---|---|---|
| 2,424,190 | 12/1975 | Germany | 66/50 R |
| 2,414,934 | 10/1975 | Germany | 66/50 R |
| 1,413,533 | 11/1975 | United Kingdom | 66/50 R |
| 1,116,744 | 6/1968 | United Kingdom | 66/50 R |

*Primary Examiner*—Louis K. Rimrodt
*Assistant Examiner*—Andrew M. Falit
*Attorney, Agent, or Firm*—Michael J. Striker

[57] ABSTRACT

A knitting machine has a housing on which is displaceable a support cylinder carrying an array of parallel needle holders displaceable up and down. Two armed levers are pivoted on each of the holders and each have a forked arm formed with an actuating foot and with an anchor foot spaced by a gap from the actuating foot, and another arm that is engaged by a spring carried on the holder that normally tries to bias the lever to move from an operative position into an inoperative position. A slide cam on the housing has lobes or formations which are engageable with the actuating feet of the levers to displace the holders and engageable between the feet of the lever so as not to displace the holders. Furthermore, a tip cam is provided on the housing engageable with the other arm of each of the levers to displace it into the operative position. A plurality of magnetic actuators each comprising an electromagnetic portion and a permanent-magnet portion are capable of holding the anchor feet in the operative position into which they are moved by the tip cam. Two sets of such needle holders are provided on the machine spaced axially from one another so that displacement speed can be doubled.

15 Claims, 3 Drawing Figures

ELECTRICALLY CONTROLLED NEEDLE SELECTOR ARRANGEMENT FOR KNITTING MACHINES

BACKGROUND OF THE INVENTION

The present invention relates to a knitting machine. More particularly, this invention concerns such a knitting machine having electromagnetically controlled needle position.

A knitting machine is known of the flatbed or circular type and having a housing on which is displaceable a support carrying a multiplicity of needles each carried on a respective needle holder. The support, in the case of a circular machine the cylinder, is displaceable in a support direction relative to the housing and the needles are displaceable in needle directions transverse to the support direction. Each of the needle holders is provided with a return foot that operates with a respective return cam to displace the needles and needle holders periodically into a bottom or cast-off position. It is furthermore known to provide each of the needle holders with an actuating foot that is displaceable relative to the needle holder in a direction transverse to the respective needle direction. A magnet is operable to displace this actuating foot into or out of a position engageable with a slide cam. When engaged with the slide cam the actuating foot causes the respective holder to be displaced up into the knit-tuck, or welt position. When the actuating foot is not engageable with the slide cam the respective needle and needle holder are not lifted and remain in the bottom position.

Such machines must invariably operate with relatively low speed as the electromagnetic actuation of the actuating feet cannot take place too rapidly. Furthermore, at high speed inherent vibrations and the like in the machine can frequently shake the actuating feet off the slide cam and cause the machine to mis-stitch.

Another difficulty with such machines is that the inevitable build up of dust and lint in them greatly slows down the cams in their grooves or raceways on the support. Thus it is necessary to provide extremely robust guide means and very powerful electromagnets to operate them in order to overcome the relatively high friction.

Various knitting machines can be seen in German Pat. Nos. 874,330 and 1,109,217, in German Published Specifications No. 1,585,208 July 30, 1970, No. 1,585,228 Aug. 6, 1970, No. 2,316,606 Oct. 11, 1973, and No. 2,327,585 Dec. 19, 1974, in German published applications No. 1,160,101 Dec. 27, 1963, No. 1,760,405 June 9, 1971, and No. 2,010,973 Jan. 27, 1972, and in U.S. Pat. No. 3,678,710.

SUMMARY OF THE INVENTION

It is therefore an object of the present invention to provide an improved knitting machine.

Another object is the provision of such a machine which can operate at very high speeds without mis-stitching.

Yet another object is to provide such a machine wherein the needle actuating feet are surely and rapidly positioned even when the apparatus is relatively heavily choked with lint or dust.

These objects are attained according to the present invention in a knitting machine of the above-described general type wherein each holder is provided with a two-arm lever that is pivoted on the holder and has one forked arm formed with the above-mentioned actuating foot and a anchor foot spaced by a gap from the actuating foot. Each of these levers is pivotal between an operative position and an inoperative position. A slide cam extends on the housing in the support direction and is engageable with the actuating feet of the levers only in the operative positions of the levers to displace the levers in the needle direction on relative displacement of the support on the housing in the support direction. A spring is provided on each holder engaging the respective lever and biasing this lever into one of its positions. A tip cam is provided on the housing extending in the support direction and engageable with the other lever arms to pivot the levers on the holders between the positions. Control means is provided for displacing the anchor feet and includes at least one magnet on the housing alignable with the anchor feet for displacing the levers against the biasing force of the spring into the other of the lever positions.

In accordance with further features of this invention each of the holders is provided with a return foot coacting with a return cam automatically to displace each of the holders into a bottom or cast-off position. Furthermore, each of the magnets is formed with a permanent-magnet portion and an electromagnet portion. Each spring normally biases the respective two arm lever by engagement with its other arm into the inoperative position, the electromagnet being effective to move it into the operative position.

Thus with the system according to the present invention a relatively light two-arm lever need merely be pivoted back and forth in order to control the actuation of the respective holder. The spring force urging in into one position and the magnetic force urging it into the opposite position can therefore be relatively great to insure fast operation of this device and displacement between the two positions even when the apparatus is relatively choked with lint.

In accordance with another feature of this invention, the slide cam is formed with a plurality of formations extending in the needle direction and engageable in the inoperative positions of the levers between the feet of the forked arm of the lever. Thus, the slide-cam formation is either engaged with the actuating foot of the lever and is displaced in the respective holder or is engaged between the feet of the lever and preventing the lever from pivoting from inoperative into the operative position. Furthermore cam means is provided on the housing which is engageable with the levers after displacement of the holders out of their bottom or cast-off position for maintaining them in their operative position. Thus once a lever is moved into the operative position and the respective holder is displaced slightly it is locked in this operative position and can only be shifted out of its operative when it is moved back into the cast-off position. These two features insure that accidental engagement or disengagement with the actuating feet except in the short selection region is ruled out.

In accordance with another feature of this invention the magnetic actuator is formed by a permanent-magnet portion and an electromagnet portion. The electromagnet portion also includes a permanent magnet but has a winding able to cancel out the magnetic force of the actuator. Thus electrical energization of the coil of each actuator prevents it from attracting the respective actuating foot, and, therefore, allows the spring to move the respective foot into the inoperative position.

To this end the actuating foot is made of mild steel. The entire lever is made of hardened or tempered steel but the actuating foot thereof is detempered by heating which gives it a relatively low magnetic remanence. Furthermore, this foot may be provided with a soft iron shoe to increase the force with which it can be attracted by the magnetic actuator.

In accordance with the further features of this invention the ability of the machine to operate at high speed is considerably increased by arranging the holders in two sets one of which is offset in the needle direction from the other set and one of which has holders which alternate with and are offset in the needle direction from the holders of the other set. It is also within the scope of this invention to provide three such offset arrangements. Such an arrangement allows the speed to be doubled right away, as the actuation distance, measured angularly between adjacent needles of the same set, is twice as long. In such an arrangement each of the needle holders as well as its lever and spring are slidable in a respective raceway or groove on the needle support.

With the system according to the present invention it is possible to operate at extremely high speeds. Each of the needle-position selector levers is displaceable extremely rapidly due to its low mass. Furthermore, the selector lever is held in whichever position it is moved into as soon as the selection zone location on the machine housing has been passed.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF THE PREFERRED EMBODIMENT

Figure 1:
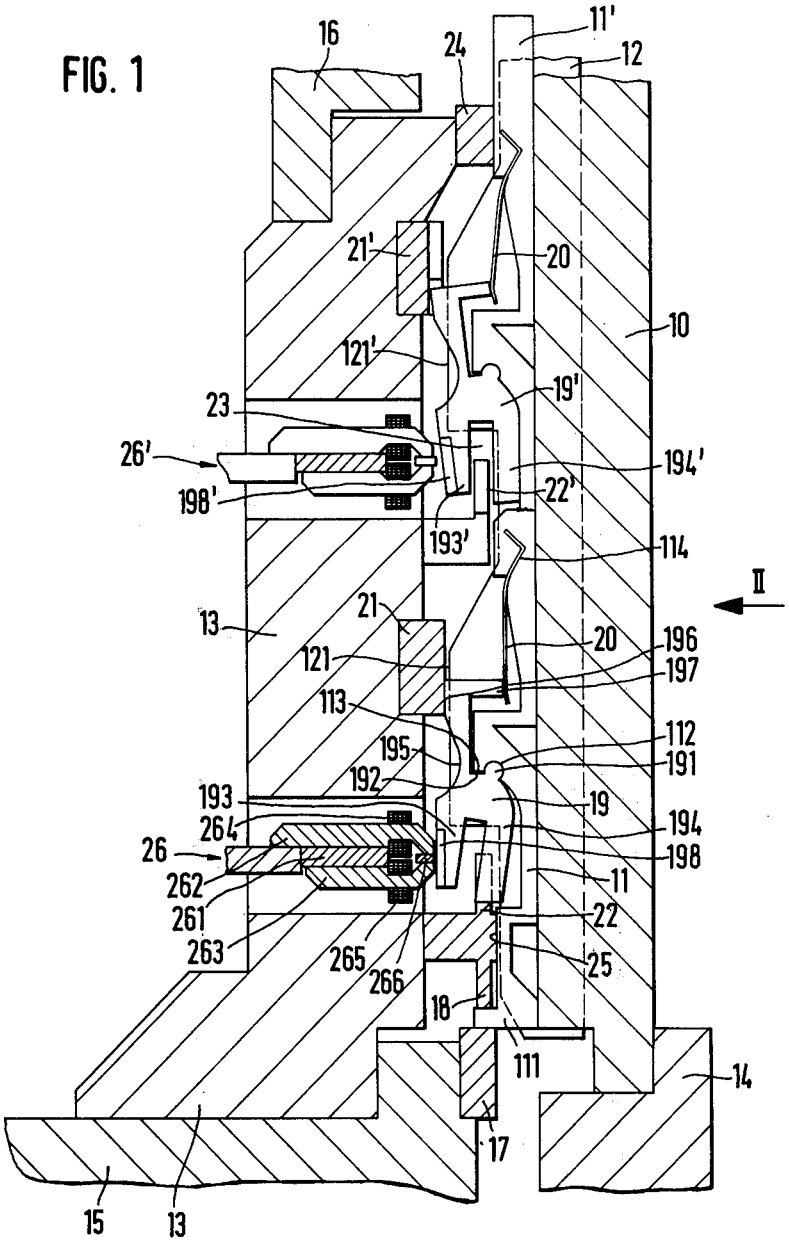
FIG. 1 is a vertical section through a portion of a knitting machine in accordance with this invention.
Figure 2:
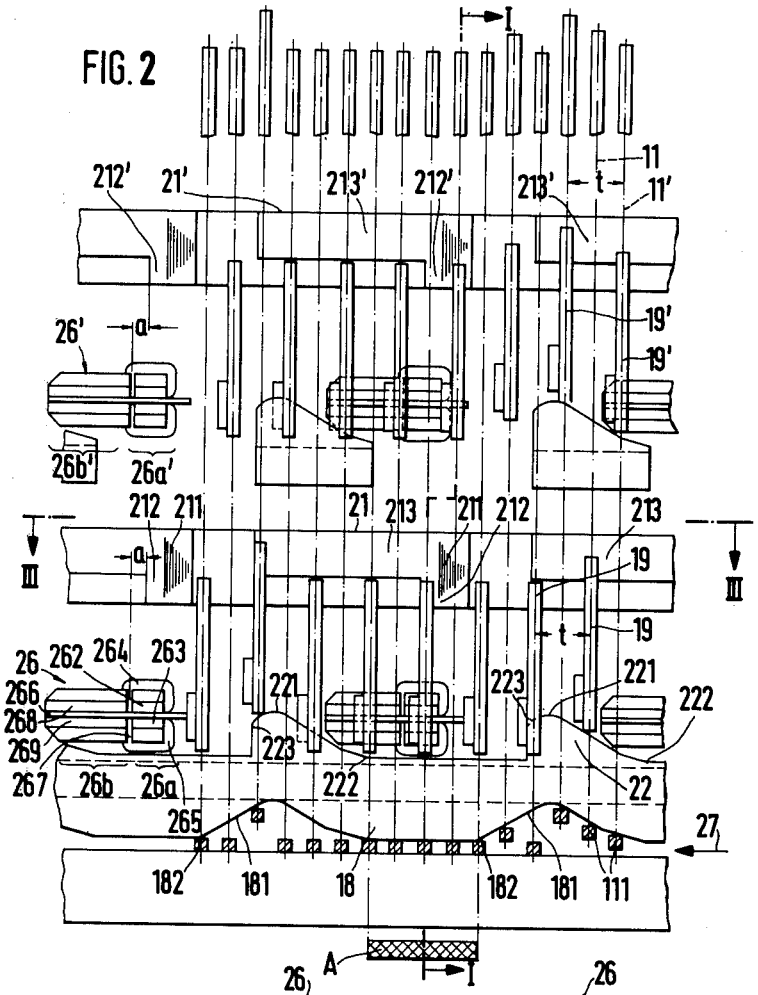
FIG. 2 is a view taken in the direction of arrow II of FIG. 1, parts being removed for clarity, line I—I of FIG. 2 being the section line for FIG. 1.

As shown in FIGS. 1 and 2 the knitting machine according to the present invention has a needle cylinder or support 10 carrying an upper set of needle pushers 11' and a lower set of needle pushers 11. The machine has a stationary housing 13 sitting on a base 15 and the needle cylinder 10 is carried on a ring 14 rotatable about a vertical axis to displace the needles in the direction of arrow 27 of FIG. 2. Guide rings 24 and 25 on the support 13 engage the pushers 11 and 11' and hold them in respective grooves defined between guide bars 12. Elements 16 carried on the housing 13 support guards for the needles and various other parts of the knitting machine.

The needle pushers or holders 11 and 11' and their associated elements are virtually identical. The same reference numerals are used for both sets of needle holders, with the reference numerals of the upper set all primed. Therefore, the discussion below will relate only to the lower set, it being understood that this description applies equally to the set of upper needles 11'.

Each of the needle holders 11 has a re-set foot 111 which is engaged between the lower guide ring 17 and a reset cam 18 fixed on the stationary housing 13 on its base 15. Each needle holder 11 is further provided with a respective two-arm actuating lever 19 having a round head 191 received in a respective round recess or groove 112 in the holder 11. Each such holder has an elastically deflatable upper arm 197 having an outer surface 196 engageable with a tipping cam 21 carried on the housing 13. Furthermore, each such actuating lever has an actuating foot 194 engageable with the top of slide cam 22 and another foot 193 carrying a soft-iron shoe 198. The lever 109 is made of hardened tempered steel, but its foot 193 is detempered by heating so as to reduce its magnetic remenance. In addition the shoe 198 is substantially wider than the respective foot 193 so as angularly to overlap the groove formed between the bars 12 and to be engageable against the outer faces 121 of these bars 12.

The lever 19 is displaceable between the operative position shown in FIG. 1 at the bottom where its foot 194 is engageable with the top of the slide cam 22 and an inoperative position as shown at the top of FIG. 1 wherein the cam 22' is engageable in the space 23 between the legs 193' and 194' of the lever 19'. In the operative position surfaces 113 and 192 on the lever 10 abut one another so that the clockwise rotation is limited in this direction, whereas in the opposite direction the leg 194 lies directly against the face of the slider 11 to limit its counterclockwise rotation.

Figure 3:
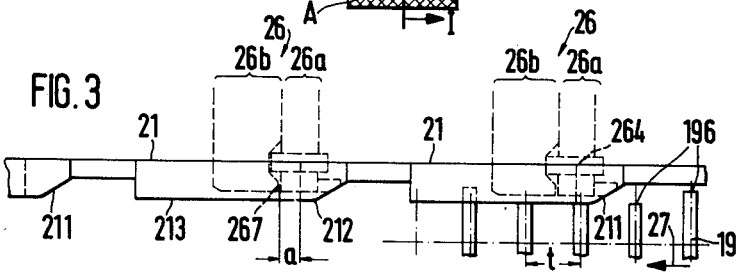
FIG. 3 is a section taken along line III—III of FIG. 2.

Adjacent the orbits of the levers 19 there is provided a succession of magnetic actuators 26 each having as shown in FIGS. 2 and 3 an electromagnetic portion **26*a* and a permanent-magnet portion 26*b*. The electromagnetic portion 26*a* has a central permanent-magnet plate 261 sandwiched between a pair of pole shoes 262 and 263 carrying respective windings 264 and 265. The ends of the pole pieces 262 and 263 grip a horizontally extending friction element 266 which projects slightly beyond the face of the magnet 26 and is engageable with the respective shoe 198. This strip extends also through the permanent-magnet portion comprised of a pair of permanent-magnet pieces 268 and 269 separated by a gap 267 from the portion 26*a*. Absent the electromagnetic actuation of the coils 264 and 265 the entire magnet 26 will attract a shoe 198. When current is passed to the coils 264 and 265 the magnetic portion 26*a* is not effective, as the electromagnetic force cancels out the permanent-magnet force of the element 261.**

Each lever 19 is biased in the counterclockwise direction by means of a respective leaf spring 20 secured at 114 in the holder 11 and engaging against the arm 197 of the lever 19. The force constantly exerted in the counterclockwise direction by this spring 20 is slightly less than the force which can be exerted by the magnet 26. It is noted however, that the magnets 26 are not sufficiently strong to pull the levers 19 from the inoperative into the operative position, but are sufficiently strong to hold them in the operative positions against the force of the springs 20 once they are in this operative position. The element 266, which is made here of polytetrafluoroethylene for minimum coefficient of friction, holds the shoe 198 slightly out of contact with the magnet 26 to prevent the two elements from freezing together.

The lower surface of the cam 18 which serves for re-setting of the feet 111 of the holders 11 and 11' has a generally straight region indicated by A in FIG. 2 in which the needle holders are all in the fully down or cast-off position. The cam 18 is notched out between these lowest regions and has a return surface 181 terminating at 182 at the upstream ends of the regions A. It is noted that the wide shoes 198 prevent displacement of the levers 19 from the operative into the inoperative position because they engage over surfaces 121 of the side bars 12 defining the raceways for the holders. Thus, when the holders are moved out of their lowermost positions they cannot be moved from the operative into the inoperative positions.

Furthermore each of the cams has an inclined surface 211 starting slightly downstream in the direction 27 from the region 182 and terminating at 212 slightly upstream of a cut-away region 213. Thus, all of the holders which have been returned to their lowermost positions by the time they reach point 282 can then be cammed by the formation 211 into their operative positions if they are not already in the operative positions. Thus, no matter what the position of the holder it will be moved fully down after passing the point 182 and the lever 19 will be moved into the operative position after passing the point 212.

At this point the shoe 198 is across from the magnetic portion 26*a*. As soon as the surface 196 of the upper arm of the lever 19, which is cut away at 195 to be deflectable relative to the lower portion, passes the upstream end of the cut-away portion 213 it enters a very short region *a* as shown in FIG. 2 which is defined between the upstream end of the portion 213 and the gap 267 between the portions 26*a* and 26*b*. If the electromagnetic portion 26*a* is not electrically energized the shoe 98 will be held against the magnet 26 and will simply slide along the element 266 and remain in the operative position. Should however the coils 264 or 265 be energized while the shoe 198 is in the region *a* the magnetic attraction will cease and the spring 20 will swing the respective lever 19 to the inoperative position. The cam 22 has a plurality of lobes starting at 222 approximately in the middle of the respective permanent magnet portion 26*b* rising to a highest point 222 and terminating at 223 at a level approximately equal to the start of the re-set zone. In the operating position of the lever the foot 194 rides on this lobe up to the point 221 and the respective needle, therefore, is displaced upwardly. As mentioned above once the needle is displaced upwardly in the operative position the shoe 198 engages over the surfaces 121 and prevent it from being moved into the inoperative position. If it is however in the inoperative position when it reaches the point 222 the legs 193 and 194 will straddle the cam 22 so that the holder 11 will not move up or down and, indeed, will be prevented from moving up or down because the cut-away portion 213 will overlie the upper end of the holder and prevent it from moving up as shown in the upper portion of FIG. 1. Furthermore, once the legs 193 and 194 straddle the cam 22 they cannot move from the operative to the inoperative position as their pivoting is blocked by this cam 22 and only after they have passed the end 223 can they pivot back into the other position.

The distance A in which the needles are all the way down is relatively long, here equal to twice the spacing *t* between adjacent holders 11 of the same set. On the contrary, however, the decision or selected region *a* is very short compared to this distance *t*, equal to approximately one-third of the distance *t*. The computer programmer that operates the various coils 264 and 265 is therefore effective in this brief instant to select the proper needle position, the selection taking place at this instance being effective thereafter until the next lobe 22 and portion 181 is reached.

It is noted that the provision of two sets of holders 11 and 11' allows the operational speed to be doubled with the same selection speed. Tripling of quadrupling of the number of sets of needles will similarly increase the speed.

Thus with the system according to the present invention each needle holder is periodically brought all the way down and is displaced into the operative position. The programming apparatus then decides whether it is to remain in this operative position or to be moved to the inoperative position, in the latter case a signal is sent to the coils 264 and 265. Once the decision is made, however, the needle moves into the inoperative position or stays in the operative position and is locked in the position it is placed into until the next cycle. The relatively light lever serves to transmit force from the cam 22 to the holder 11 and yet can readily be electromagnetically attracted and repelled and displaced by the spring 20 so that even if the machine is relatively clogged with lint it will operate surely.

It will be understood that each of the elements described above, or two or more together, may also find a useful application in other types of apparatus differing from the types described above.

While the invention has been illustrated and described as embodied in a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knitting machine comprising: a housing; a support displaceable relative to said housing in a support direction; an array of parallel needle holders spaced apart in a needle direction on said support and displaceable thereon in said needle direction transverse to said support direction; a two-arm lever pivoted on each of said holders and having one forked arm formed with an actuating foot and with an anchor foot spaced by a gap from said actuating foot, and another arm, each lever being pivotal between an operative position and an inoperative position; a slide cam on said housing extending in said support direction and engageable with said actuating feet of said levers in said operative positions thereof to displace said levers in said needle direction on relative displacement of said support on said housing in said support direction; a spring on each holder engaging the respective lever and biasing same into one of said positions; a tip cam on said housing extending in said support direction and engageable with said other arm to pivot said levers on said holders between said positions; and control means for displacing said anchor feet and including at least one magnet on said housing alignable with said anchor feet for displacing said levers against the biasing force of said spring into the other of said positions.

2. The machine as defined in claim 1 wherein said one position is said inoperative position and said other position is said operative position.

3. The machine defined in claim 2 wherein each magnet comprises a permanent-magnet portion and electromagnet portion, said permanent-magnet portion being downstream in said support direction.

4. The machine defined in claim 3 wherein said tip cam has a plurality of tipping formations spaced apart in said support direction and each terminating upstream of a respective permanent-magnet portion by a spacing having a length in said support direction shorter than the distance in said support direction between adjacent needle holders, each of said tipping formations serving to displace needle holders from inoperative positions into operative positions.

5. The machine defined in claim 2 wherein said support is formed with a plurality of parallel grooves extending in said needle direction and each holding one such holder with the respective spring and lever.

6. The machine defined in claim 2 wherein said slide cam is in said gap and operatively unengageable with the respective lever in the inoperative position thereof.

7. The machine defined in claim 6 wherein each of said levers is made of hardened steel outside of their actuating feet which are mild detempered steel.

8. The machine defined in claim 7 wherein said support is formed with a plurality of parallel grooves each slidably receiving a respective holder and lever and each of said actuating feet is provided with a soft-iron shoe engageable with said magnet and of a width in said support direction greater than the respective groove.

9. The machine defined in claim 2 wherein said levers are each provided with a round head and said holders are each formed with a round recess receiving the respective head, said holders and said levers each having respective surfaces abutting one another in said operative position and mutually spaced in said inoperative position.

10. The machine defined in claim 2 wherein said other arm of each lever is elastically deflectable relative to said one arm of the respective lever.

11. The machine defined in claim 2, further comprising means for maintaining said levers in said operative position on displacement of said levers by said slide cam.

12. The machine defined in claim 2 wherein said holders are arrayed in two sets with the holders of one set alternating with and offset to the holders of the other set.

13. The machine defined in claim 2 wherein said housing is provided with a pair of guides engaging said holders to either side of said levers in said needle direction.

14. The machine defined in claim 2 wherein said array is annular and said support is rotatable in said housing.

15. The machine defined in claim 2 wherein said holder is provided with a return foot and said housing has a cam engageable with said return feet for displacing said holders in said needle direction.

* * * * *